US006123561A

United States Patent [19]

Turner et al.

[11] Patent Number: 6,123,561

[45] Date of Patent: Sep. 26, 2000

[54] ELECTRICAL COUPLING FOR A MULTISECTION CONDUIT SUCH AS A DRILL PIPE

[75] Inventors: William E. Turner; Denis P. Biglin, Jr., both of Bethlehem; Ronald Seppa, Hellertown, all of Pa.

[73] Assignee: APS Technology, Inc., Cromwell, Conn.

[21] Appl. No.: 09/115,031

[22] Filed: Jul. 14, 1998

[51] Int. Cl.[7] ..... H01R 4/60

[52] U.S. Cl. ..... 439/194

[58] Field of Search ..... 439/190–196

[56] References Cited

U.S. PATENT DOCUMENTS

| | | | |
|---|---|---|---|
| 2,000,716 | 5/1935 | Polk | 174/47 |
| 2,096,359 | 10/1937 | Hawthorn | 174/47 |
| 2,178,931 | 11/1939 | Crites et al. | 439/191 |
| 2,197,392 | 4/1940 | Hawthorn | 174/47 |
| 2,301,783 | 11/1942 | Lee | 439/191 |
| 2,531,120 | 11/1950 | Feaster | 175/104 |
| 3,170,137 | 2/1965 | Brandt | 340/855.1 |
| 3,253,245 | 5/1966 | Brandt | 439/191 |
| 3,696,332 | 10/1972 | Dickson, Jr. et al. | 340/855.1 |
| 4,012,092 | 3/1977 | Godbey | 439/191 |
| 4,022,518 | 5/1977 | Gattaz | 439/28 |
| 4,039,237 | 8/1977 | Cullen et al. | 439/352 |
| 4,095,865 | 6/1978 | Denison et al. | 439/191 |
| 4,322,121 | 3/1982 | Riches et al. | 439/312 |
| 4,799,544 | 1/1989 | Curlett | 166/65.1 |
| 5,144,126 | 9/1992 | Perry et al. | 250/269.3 |
| 5,216,242 | 6/1993 | Perry et al. | 250/254 |

*Primary Examiner*—Hien Vu

*Attorney, Agent, or Firm*—Woodcock Washburn Kurtz Mackiewicz & Norris LLP

[57] ABSTRACT

A coupling that makes electrical connections across a joint joining adjacent tubular members, such as drill pipe sections in a drill string. A male sleeve, made from an electrical insulating material, is attached to the male end of one pipe section. A number of axially spaced apart male contact members, such as ring segments or buttons, are formed on the outside surface of the male end. The male contact members are spring biased radially outward. Each of the male contact members is radially displaced from the axial centerline of the pipe section by a progressively increasing amount. A female sleeve, also made from an electrical insulating material, is attached to the female end of the other pipe section. A number of female contact members, such as ring segments or buttons, are formed on the inside surface of the female end. Each of the female contact members is radially displaced from the axial centerline of the pipe section by a progressively increasing amount. The axial spacing and radial displacements of the male and female contact members is such that when the pipe section are assembled by threading the male end into the female end, each male contact member makes electrical contact with its intended mating female contact member without ever having contacted any of the other female contact members. Deformable cleaning elements formed on one of the ends wipe clean the contact members formed on the other end as the joint is being assembled. The debris wiped clean is deposited in a groove located in front of the wiper.

17 Claims, 12 Drawing Sheets

ELECTRICAL COUPLING FOR A MULTISECTION CONDUIT SUCH AS A DRILL PIPE

FIELD OF THE INVENTION

The current invention is directed to an electrical coupling for a multi section conduit, such as a drill pipe, that allows two or more conductors to be connected by insertion of one conduit section into the other section.

BACKGROUND OF THE INVENTION

In underground drilling, such as gas, oil or geothermal drilling, a bore is drilled through a formation deep in the earth. Such bores are formed by connecting a drill bit to a long assembly commonly referred to as a "drill string" that extends from the surface down to the drill bit. Drill strings are formed by connecting sections of drill pipe, which are typically made from steel or a composite material, typically in lengths of about 30 feet. The pipe sections are joined by threading the ends of the pipe sections so that a threaded male coupling on the end of one section screws into a threaded female coupling on the adjacent section, thereby forming a threaded joint.

As the drill bit advances into the earth, it forms the bore. In order to lubricate the drill bit and flush cuttings from its path, a high pressure fluid, referred to as "drilling mud," is directed through an internal passage in the drill string and out through the drill bit. The drilling mud then flows to the surface through the annular passage formed between the drill string and the surface of the bore. Depending on the drilling operation, the pressure of the drilling mud flowing through the drill string internal passage will typically be between 1,000 and 20,000 psi. In addition, there is a large pressure drop at the drill bit 8. Consequently, the pressure of the drilling mud flowing through the annular passage (that is, outside of the drill string) may be 200 to 3,000 psi less than that of the pressure of the drilling mud flowing inside the drill string. Thus, a large pressure gradient acts radially across the joints joining adjacent sections of drill pipe. In addition to withstanding the pressure gradient, the joints between the drill pipe sections must also be sufficiently strong to withstand the torque, axial, and bending loads associated with the advancement and retraction of the drill bit. Consequently, the structural integrity of the joints cannot be compromised.

The distal end of the drill string, which includes the drill bit, is referred to as the "downhole assembly." In addition to the drill bit, the downhole assembly often includes specialized modules within the drill string that make up the electrical system for the drill string. Such modules may include sensing modules, a control module and a pulser module. The sensing modules may provide the drill operator with information concerning the formation being drilled through using techniques commonly referred to as "measurement while drilling" (MWD) or "logging while drilling" (LWD). Alternatively, the sensing modules may provide information concerning the direction of the drilling and can be used, for example, to control the direction in which the drill bit advances in a steerable drill string. Signals from the sensor modules are typically received and processed in the control module, which may direct the pulser modules to generate pulses within the flow of drilling fluid that contain information derived from the sensor signals. These pressure pulses are transmitted to the surface, where they are detected and decoded, thereby providing information to the drill operator.

As can be readily appreciated, electrically interconnecting the components of such an electrical system requires running electrical conductors through the drill pipe sections, which, in turn, requires that electrical connections be formed across the threaded joints coupling adjacent pipe sections.

In the past, such electrical connections have been made by installing contact rings in the radially extending faces of the pipe sections that come into electrical contact when the joint is fully assembled. One such approach is disclosed in U.S. Pat. No. 4,095,865 (Denison et al.). Unfortunately, this approach is unwieldy when multiple connections must be made across the same joint since there is insufficient space on the pipe section faces to permit multiple concentric contact rings. One approach for making multiple connections is to use a single ring with segmented contacts. However, this approach requires careful timing of the threading. Moreover, due to the environment associated with the drilling site, it is difficult to keep the contacts clean prior to and during assembly. Dirt and debris on the contact members can result in poor signal transmission.

Consequently, it would be desirable to provide an apparatus for making good quality electrical connections between multiple conductors across a joint coupling two tubular members, such as a joint in a drill string.

SUMMARY OF THE INVENTION

It is an object of the current invention to provide an apparatus for making good quality electrical connections between multiple conductors across a joint coupling two tubular members, such as a joint in a drill string. This and other objects is accomplished in a coupling assembly, comprising first and second tubular members and means for joining the two member together so as to form an assembly. The first tubular member has (i) a male end defining an axial centerline thereof and forming an outside surface thereon, (ii) first and second contact members projecting radially outward from the outside surface of the male end, the first and second contact members axial spaced apart and displaced from the axial centerline by first and second distances, respectively, the second distance being greater than the first distance, and (iii) first and second electrical conductors disposed in the first tubular member, the first and second electrical conductors connected to first and second contact members, respectively. The second tubular member has (i) a female end forming a substantially cylindrical inside surface thereon, (ii) third and fourth contact members projecting radially inward from the inside surface of the female end, the third and fourth contact members axially spaced apart and displaced from the second axial centerline by third and fourth distances, respectively, the fourth distance being greater than the third distance, and (iii) third and fourth electrical conductors disposed in the second tubular member, the third and fourth electrical conductors connected to third and fourth contact members. The means for joining the first tubular member to the second tubular member places the first contact member into contact with the third contact member without having contacted the fourth contact member and the second contact member into contact with the fourth contact member without having contacted the third contact member. Thus, the first conductor is placed in electrical communication with the third conductor and the second conductor is placed in electrical communication with the fourth conductor.

According to a preferred embodiment of the invention, the tubular members comprises section of drill pipe that forms a section of a drill string. Further, cleaning elements are provided for wiping the contact members on the female end clean as the two pipe sections are being joined.

DESCRIPTION OF THE PREFERRED EMBODIMENT

Figure 1:
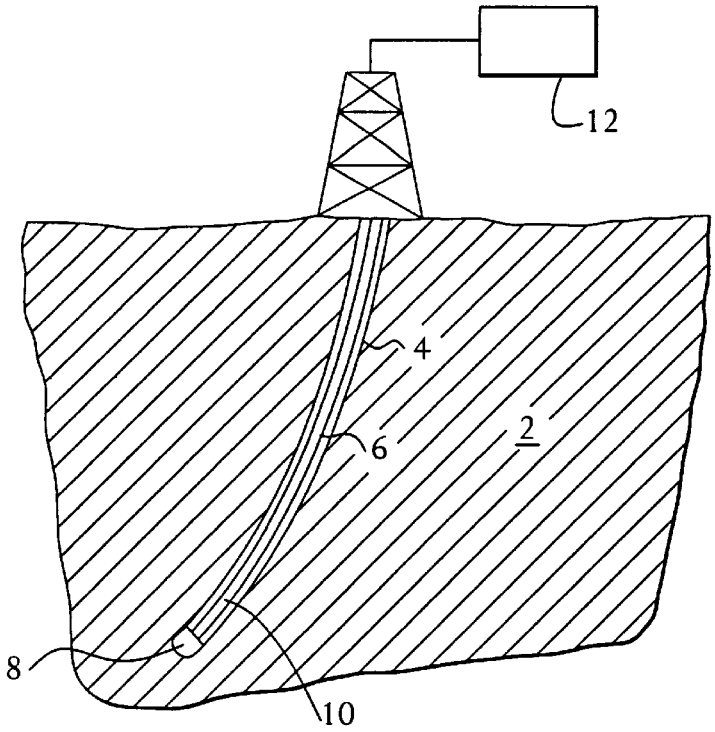
FIG. 1 is cross-section through a drill string according to the current invention in use forming a bore.

A drilling operation according to the current invention is shown in FIG. 1. A drill rig 1 drives a drill string 6 that, as is conventional, is comprised of a number of interconnecting sections. A down hole assembly 10 is formed at the distal end of the drill string 6. The down hole assembly 10 includes a drill bit 8 that advances to form a bore 4 in the surrounding formation 2. A centrally disposed passage is formed within the sections of drill string 6 and allows drilling mud to be pumped from the surface down to the drill bit 8. After exiting the drill bit 8, the drilling mud flows up through an annular passage formed between the outer surface of the drill string 6 and the internal diameter of the bore 4 for return to the surface.

Figure 2:
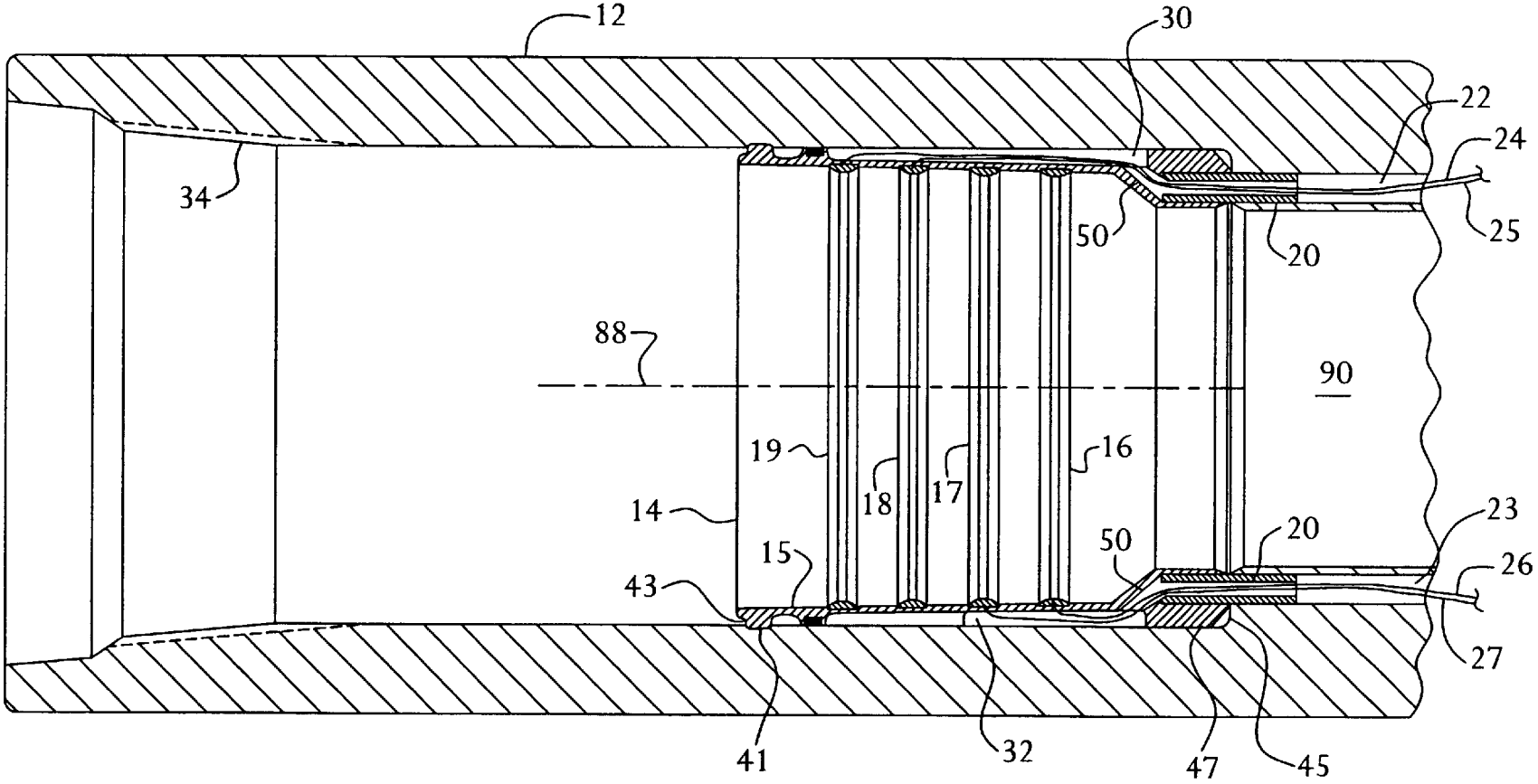
FIG. 2 is a longitudinal cross-section through the female end of a section of drill pipe, according to the current invention, that forms a section of the drill string shown in FIG. 1.

As previously discussed, electrical signals are gathered and processed in the down hole assembly 10 prior to being communicated to a control system 12 at the surface. Electrical communication between sections of drill string 6 requires that electric conductors be electrically connected across the joints between the drill pipe sections. FIG. 2 shown the female end 12 of one of the drill pipe sections constructed according to the current invention. As is conventional, the drill pipe section forms a central passage 90 through which the drilling mud flows. As is also conventional, female pipe threads 34 are formed on the internal surface of the female end 12.

Figure 3:
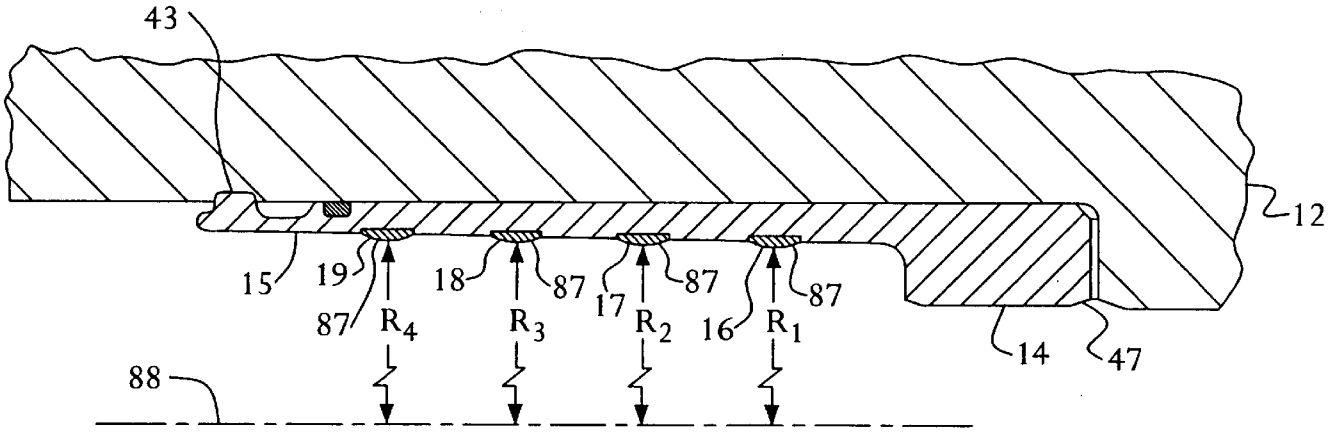
FIG. 3 is a detailed view of the female sleeve of the female end of the drill string section shown in FIG. 2 but at a different circumferential location than that shown in FIG. 2.
Figure 6:
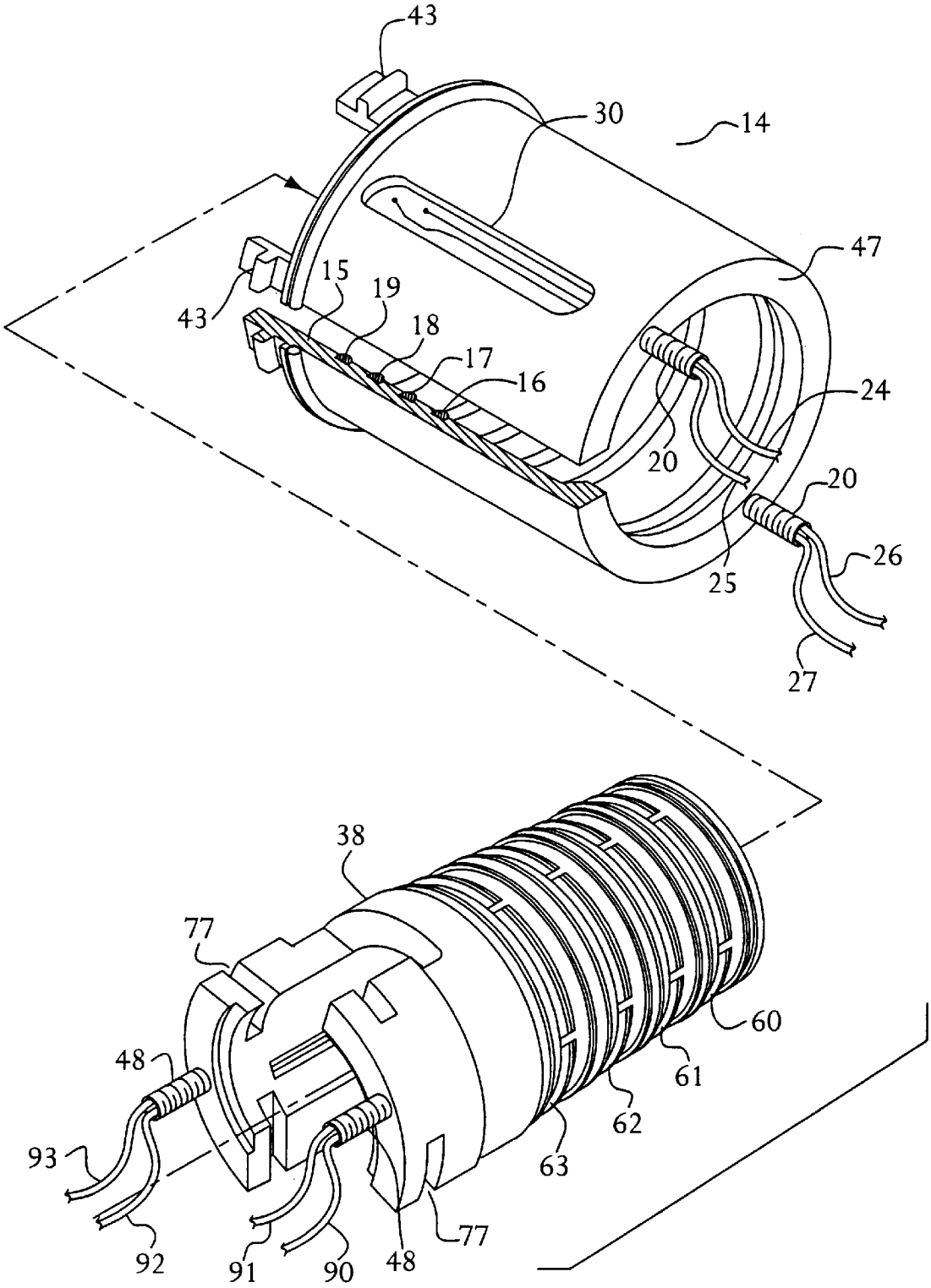
FIG. 6 is an isometric exploded view of the sleeves for the male and female ends of the drill pipe sections according to the current invention.

According to the current invention, a substantially cylindrical female sleeve 14, shown best in FIGS. 2, 3 and 6, is disposed within the female end 12 of the drill pipe section. The female sleeve 14 is formed from an electrical insulating material, such as fiberglass or PEEK plastic. A number of lugs 43 are spaced around the outer circumference of the sleeve 14 adjacent its front end and project radially outward. The inside surface 15 of the female sleeve 14 is substantially cylindrical and is preferably tapered so as to form an acute angle with the centerline 88.

As shown in FIG. 2, a circumferential groove 41 is machined in the inside surface 15 of the female end 12 of the drill pipe section. The lugs 43 of the sleeve 14 are held within the groove 41 by a snap fit. The sleeve 14 is axially retained between the groove and a shoulder 45 formed in the internal surface of the drill pipe section. In addition, two hollow dowel pins 20 are disposed in two axial passages 22 and 23 that extend from the female end 12 of the drill pipe section through the rear flange 47 of the female sleeve 14. The dowels 20 prevent rotation of the female sleeve 14 within the pipe section. The axial passages 22 and 23 are each connected to an angled passage 50 formed in the female sleeve rear flange 47.

Figure 8:
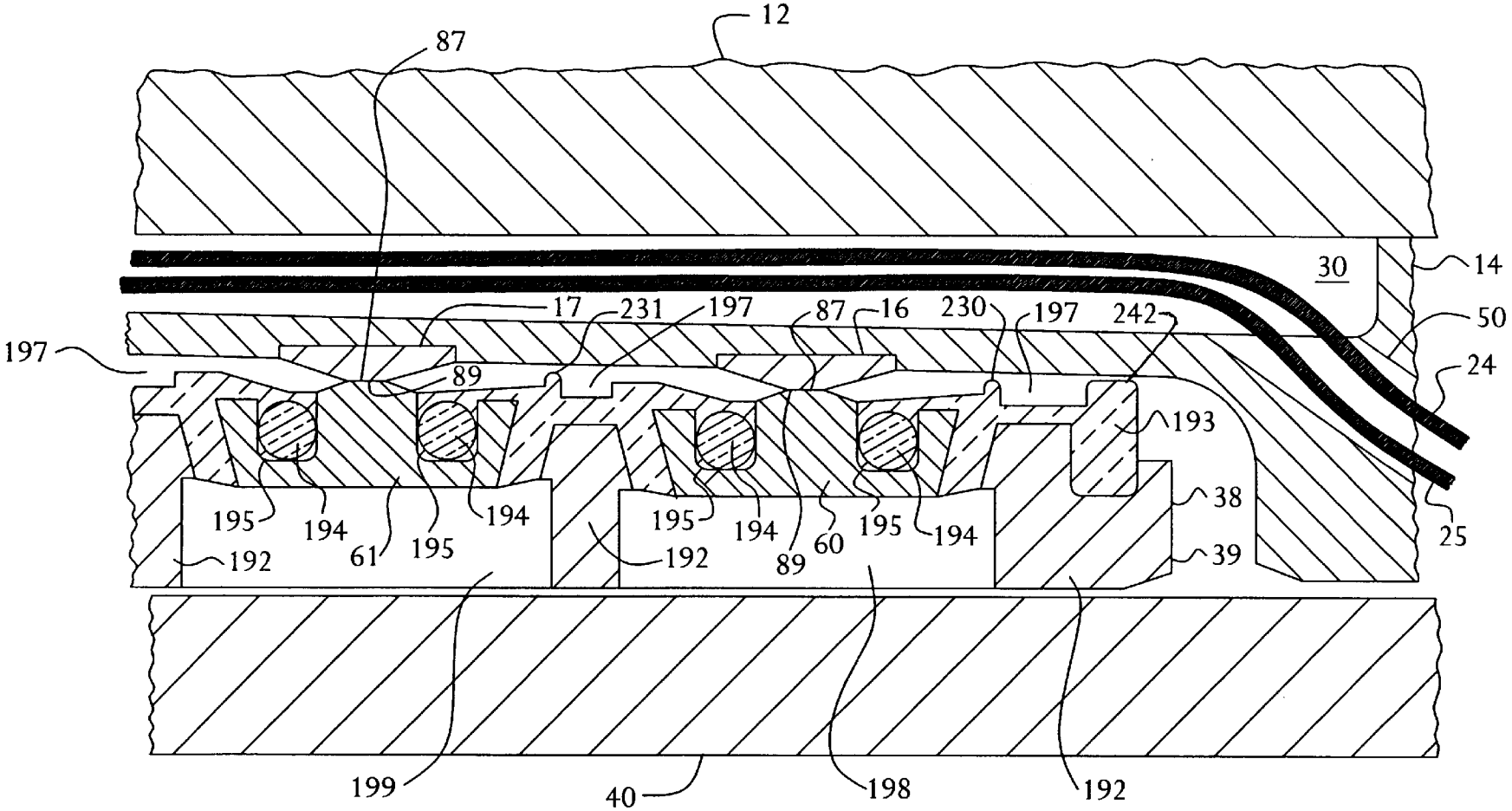
FIG. 8 is a detailed view of the portion of FIG. 7 enclosed in the rectangle designated VIII.
Figure 9:
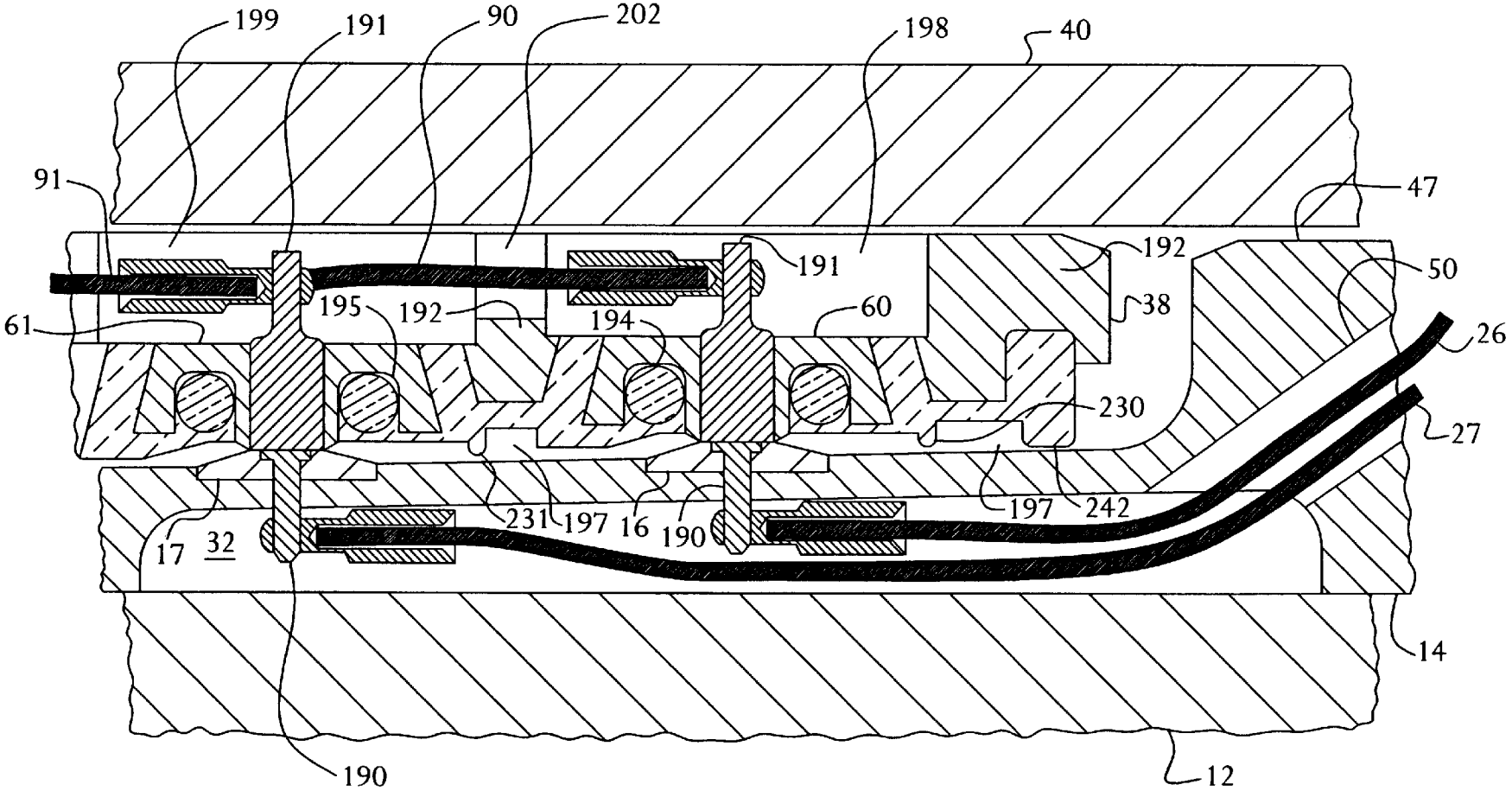
FIG. 9 is a detailed view of the portion of FIG. 7 enclosed in the rectangle designated IX.

Four axially spaced apart, annular contact rings 16–19 are located in shallow circular grooves formed on the inside surface 15 of the female sleeve 14 and project radially inward below the inside surface. As shown in FIGS. 3 and 8, the inner most surface of each of the contact rings 16–19 forms a cylindrical contact surface 87. Preferably, the contact rings are axially spaced apart by at least 0.2 inch. The contact rings 16–19 are made from an electrically conductive material such as copper or beryllium copper and are held in their retaining grooves by compression. As shown in FIG. 2, four electrical conductors 24–27 are attached to the four contact rings 16–19. As shown in FIG. 9, pins 190 are employed to attach conductor 26 to contact ring 16, and to attach conductor 27 to contact ring 17. Similarly, pins are used to attach conductor 24 to contact ring 18 and to attach conductor 25 to contact ring 19.

Two elongate recess 30 and 32, one of which is shown in FIG. 6, are formed approximately 180° apart on the outside surface of the female sleeve 14. As shown in FIG. 2, the recesses 30 and 32 form axially extending passages between the outside surface of the female sleeve 14 and the inside surface of the pipe section. Conductors 24 and 25 extend through the first passage 22 in the drill pipe section and are then routed through the first hollow dowel pin 20, the first angled hole 50, and the first recess 30 before being finally terminated at the contact rings 18 and 19, respectively. Similarly, conductors 26 and 27 extend through the second passage 23 in the drill pipe section and are then routed through the second hollow dowel pin 20, the second angled hole 50, and the second recess 32 before being finally terminated at the contact rings 16 and 17, respectively.

Figure 4:
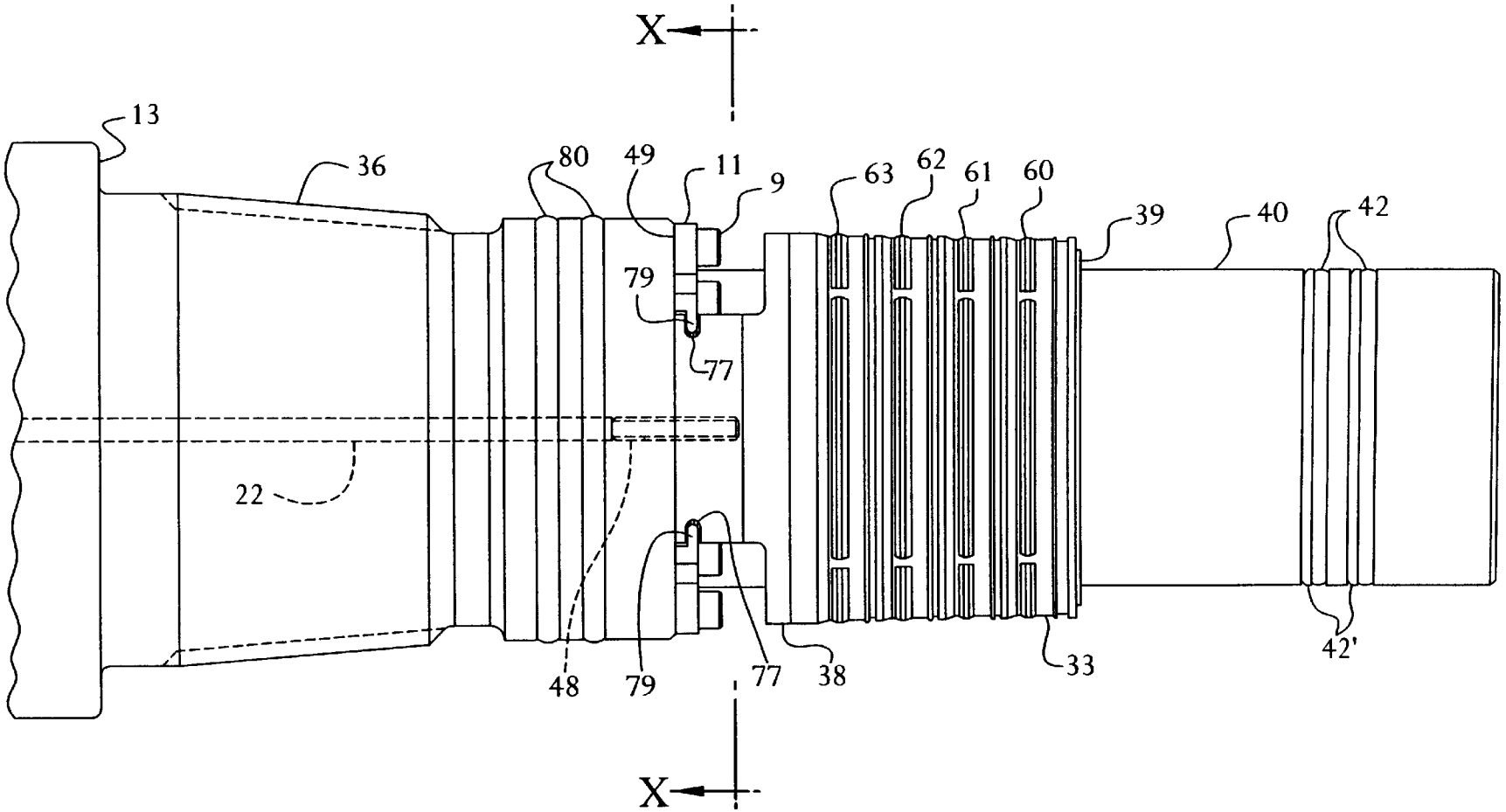
FIG. 4 is a side view of the male end of a section of drill pipe, according to the current invention, that forms a section of the drill string shown in FIG. 1 and that mates with the female end shown in FIG. 2.
Figure 10:
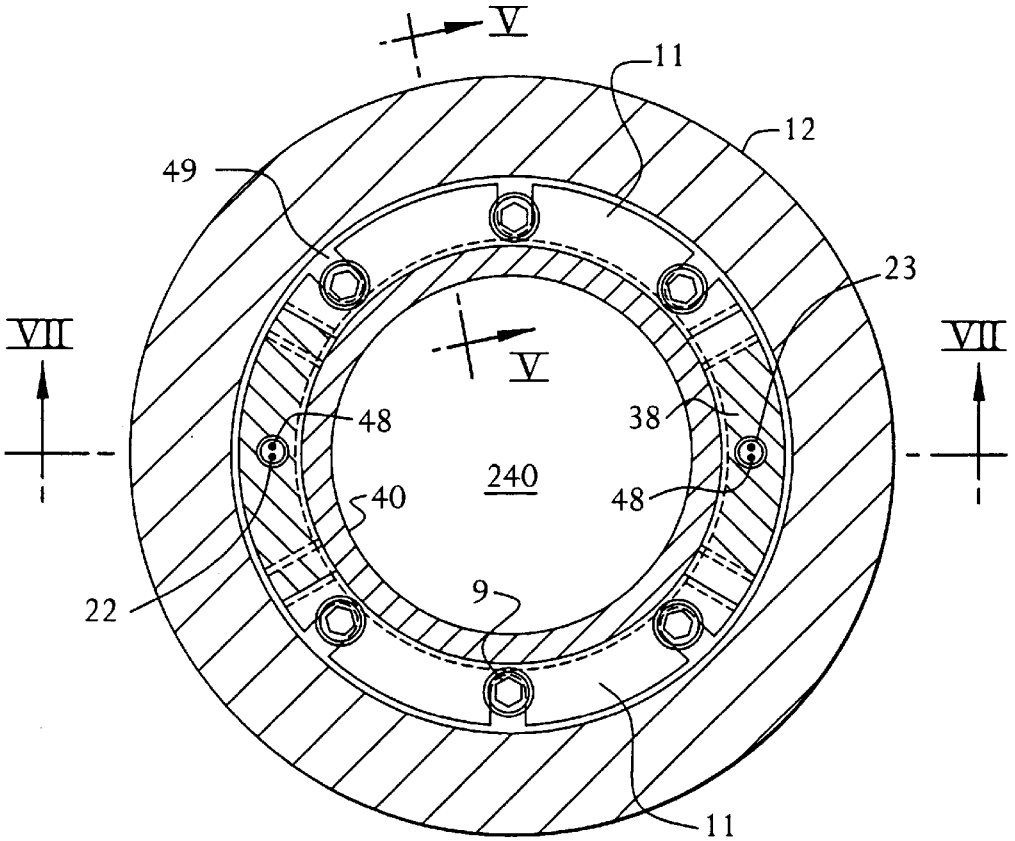
FIG. 10 is a transverse cross-section of the a drill pipe section taken through line X—X shown in FIG. 4 after assembly of the male end into the female end.
Figure 14:
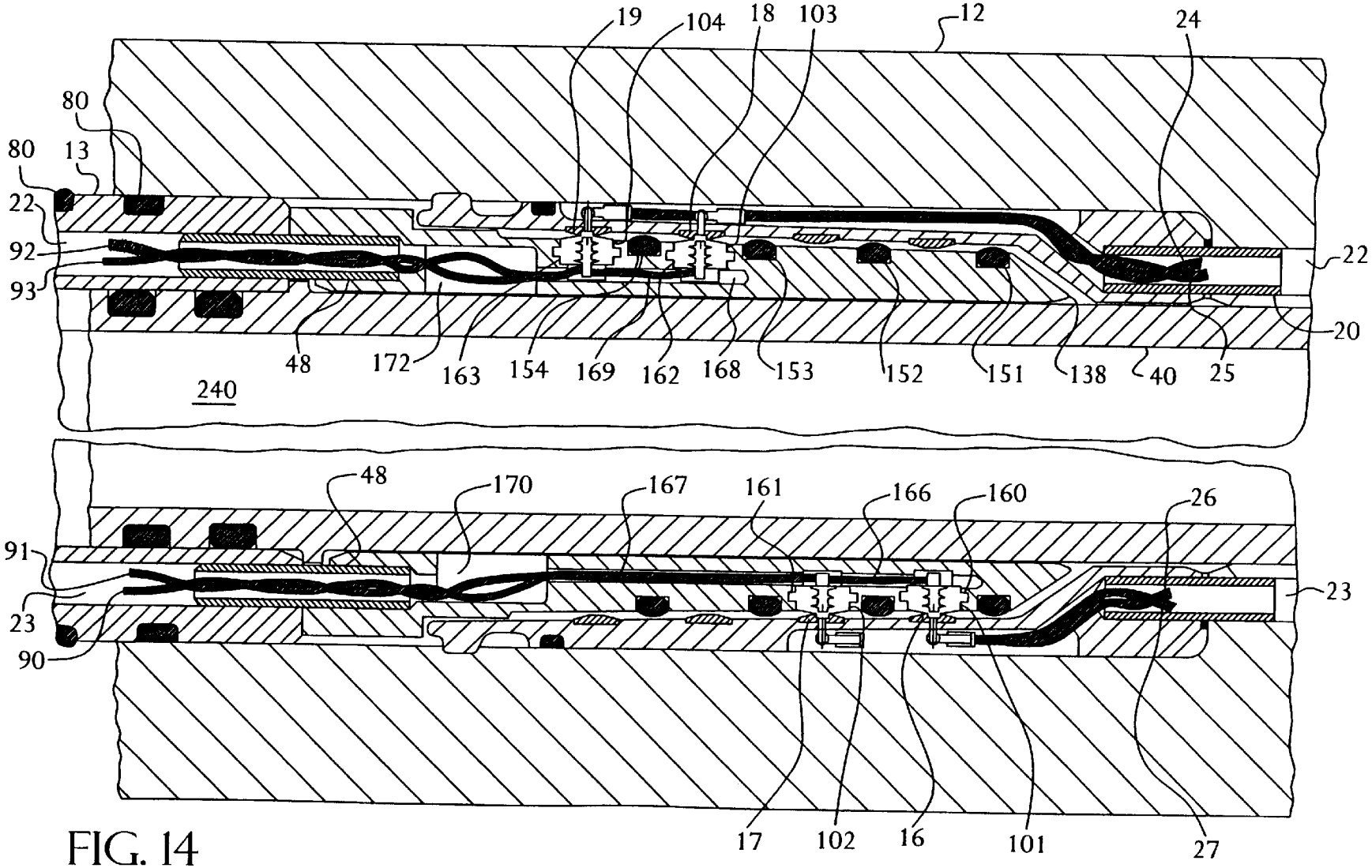
FIG. 14 is a longitudinal cross-section through male and female ends of adjacent drill pipe sections showing the completed assembly employing the male end shown in FIG. 13.

The male end 13 of the adjacent drill pipe section, which is also constructed according to the current invention, is shown in FIGS. 3, 4 and 6. Male pipe threads 36 are formed on the outer surface of the section that mate with the threads 34 formed in the female end of the first drill pipe section. In addition, as is conventional, two O-ring seals 80 are formed in the outer surface of the male end 13 and seal against the female end 12 when the joints are assembled, as shown in FIG. 14. If it is necessary to route conductors through the entire length of a drill pipe section, then the male end of the section would be constructed as shown in FIG. 4 and the female end of the same section would be constructed as shown in FIG. 2. The mating ends of the sections on either side of that section would also have ends constructed according to the current invention. However, if the conductors terminate or originate within a drill pipe section, then only the end of the section that mates with another section carrying conductors need be constructed according to the current invention. Thus, according to the current invention, drill pipe sections may have both ends specially made according to the current invention, or may have only the female end or the male end specially made. As shown in FIGS. 4 and 10, if both ends of the drill pipe section are made according to the current invention, then the two axially extending passages 22 and 23, discussed above in connection with the female end, extend through the male end as well.

Figure 5:
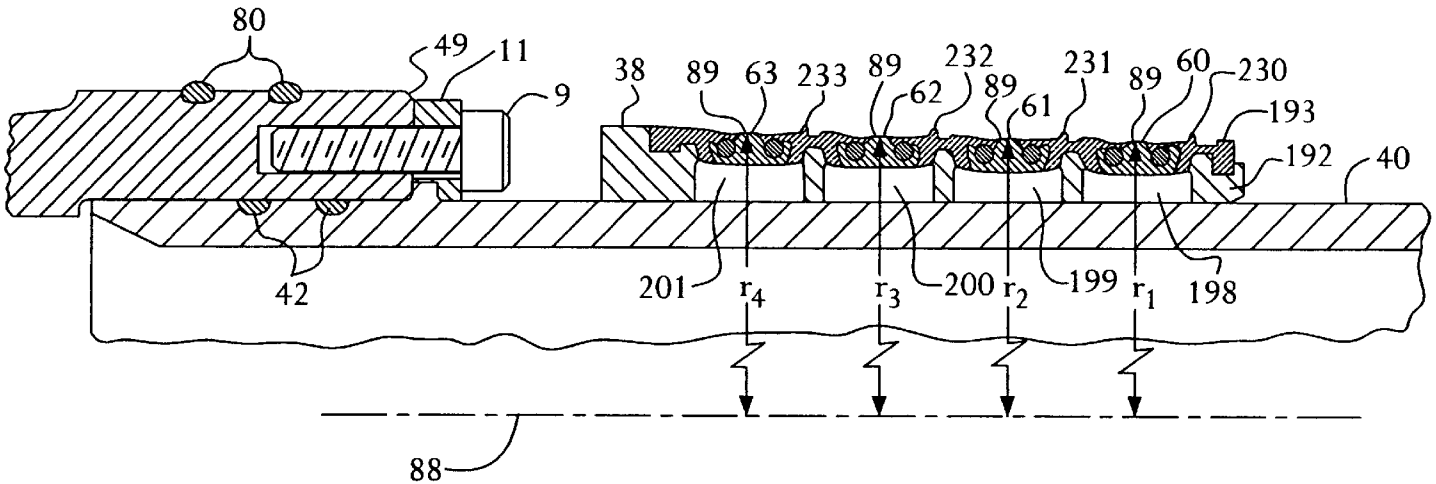
FIG. 5 is a longitudinal cross-section through the male end of a drill pipe section shown in FIG. 4 taken along line V—V shown in FIG. 10.

As shown in FIGS. 4 and 5, according to the invention, a substantially cylindrical male sleeve 38 is attached to a flange 49 formed on the body of the male end 13 of the drill pipe section and forms a portion of the distal end of the male end. The outside surface 33 of the male sleeve 38 is substantially cylindrical and is preferably tapered so as to form an acute angle with the centerline 88. As shown best in FIGS. 4 and 10, two arcuate retaining plates 11 are bolted to the flange 49 by screws 9. The retaining plates 11 form fingers 79 that engage slots 77, shown best in FIG. 6, in the male sleeve 38, thereby securing the male sleeve onto the body of the male end 13. In addition, two hollow dowel pins 48 are disposed in the portion of the two axial passages 22 and 23 that extend from the male end 13 of the drill pipe section into the male sleeve 12, as shown in FIG. 4.

A seal tube 40, which may be made from a flexible metal, is held within the inner surface of the male sleeve 38. The seal tube 40 extends forward beyond the end of the male sleeve 38 and rearward toward the threads 36. A pair of O-rings 42 are formed in circular grooves at each end of the seal tube 40. The rear pair of O-rings 42 seal against the inner surface of the male end 13 of the drill pipe section, as shown in FIG. 5. The forward pair of O-rings 42, which include backup rings 42', seal against the inner surface of the female end 13 of the adjacent drill pipe section. A central passage 240 is formed within the seal tube 40 that allows the drilling mud to flow through the joint between the two drill pipe sections.

Figure 11:
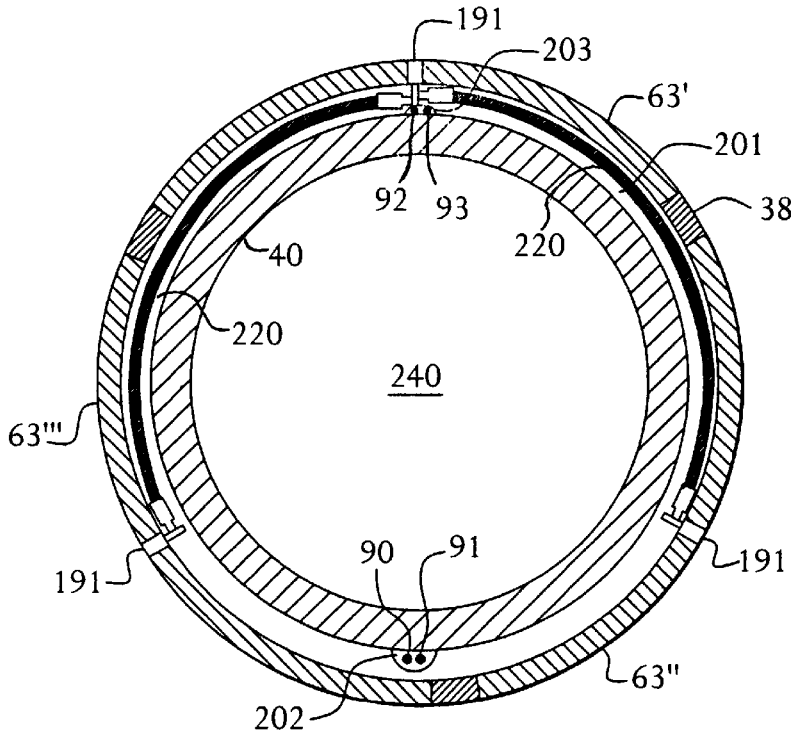
FIG. 11 is a transverse cross-section of the male end of the a drill pipe section taken through line XI—XI shown in FIG. 7.

As shown best in FIGS. 5 and 8, the male sleeve 38 includes four axially spaced male contact rings 60–63. The contact rings 60–63 are made from an electrically conductive material such as copper or beryllium copper. Preferably, each male contact ring 60–63 is comprised of a three circumferentially extending arcuate segments joined by conductors 220 disposed in the circumferential passages 198–201 extending under each of the male contact rings, as shown for contact ring 63 in FIG. 11, which is typical. As shown best in FIGS. 5 and 8, in transverse crosssection, each male contact ring 60–63 is shaped like a crown and has a cylindrical outer most surface that forms a contact surface 89 that mates with a contact surfaces 87 of one of the contact rings 16–19 formed in the female sleeve 14. The male contact rings 60–63 are embedded in an electrically insulating, resilient elastomeric material 193, such as viton or nitrile, that is formed on a support structure 192. The support structure 192 is formed from an electrical insulating material, such as fiberglass or PEEK plastic.

Preferably, the male sleeve 38 is made by first forming an approximately cylindrical support, a portion of which ultimately becomes the support structure 192. As shown best in FIG. 8, each segmented contact rings 60–63 is then clamped around the support by means of a pair of O-rings 194 that are disposed in a pair of grooves 195 formed in each ring. The elastomeric material 193 is then molded around this assembly. The inside diameter of the support is then machined so as to form circumferentially extending passages 198–201 and axially extending passages 202 and 203, shown best in FIG. 7, thereby forming the finished support structure 192.

Figure 7:
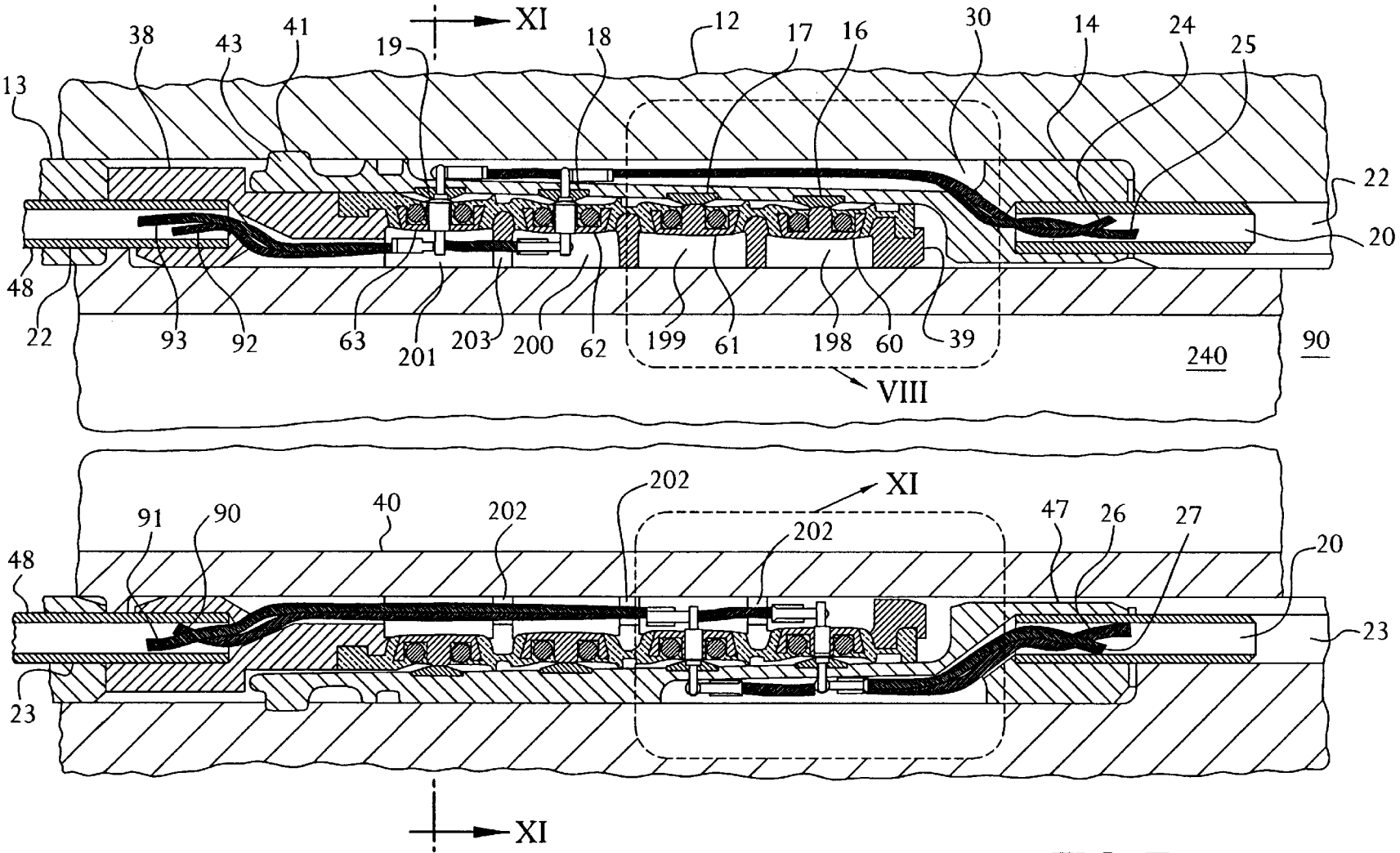
FIG. 7 is a longitudinal cross-section through male and female ends of adjacent drill pipe sections showing the completed assembly, taken along line VII—VII shown in FIG. 10.

Conductors 90 and 91 extend through the portion of the axial passage 23 in the male end 13 and are then routed through dowel pin 48, as shown in FIGS. 7 and 9. From dowel pin 48, conductor 90 is routed through circumferentially extending passages 198–201 and axial passages 202 in the male sleeve 38 and is finally terminated at contact ring 60 by means of a pin 191. Conductor 91 is routed through circumferentially extending passage 199–201 and axial passage 202 in the male sleeve 38 and is finally terminated at contact ring 61 by means of a pin 191. Similarly, conductors 92 and 93 extend through the portion of axial passage 22 in the male end 13 and are then routed through dowel pin 48. From dowel pin 48, the conductor 92 is routed through circumferential passage 201 and axial passage 203 in the male sleeve 38 to circumferentially extending passage 200 and is finally terminated at contact ring 62 by means of a pin 191. Conductor 93 is routed to circumferentially extending passage 201 and finally terminated at contact ring 63 by means of a pin 191.

According to an important aspect of the invention, the contact rings 60–63 in the male sleeve 38 are not only axially spaced along the outside surface 33 of the male sleeve 38, they are progressively radially displaced from the centerline 88 of the drill string. Thus, as shown in FIG. 5, the contact surface 89 of first ring 60 is displaced by distance $r_1$ from the centerline 88, while the contact surface of the fourth ring 63 is displaced by distance $r_4$ from the centerline. The contact surfaces of the second and third rings 61 and 62 are displaced by distances $r_2$ and $r_3$ from the centerline, respectively. The dimensions $r_1$ to $r_4$ progressively increase so that $r_4$ is greater than $r_3$ , $r_3$ is greater than $r_2$ , and $r_2$ is greater than $r_1$—that is, $r_{i+1}>r_i$, where i is the number of the contact ring. Thus, the contact surfaces 89 of the rings 60–63 are distributed along a cone about the centerline 88.

Similarly, the contact rings 16–19 in the female sleeve 14 are not only axially spaced along the inside surface 15 of the female sleeve 14, each is progressively radially displaced from the centerline 88 of the drill string. Thus, as shown in FIG. 3, the contact surface 87 of the first ring 16 is displaced by distance $R_1$ from the centerline 88, while the contact surface of the fourth ring 19 is displaced by distance $R_4$ from the centerline. The contact surfaces of the second and third rings 17 and 18 are displaced by distances $R_2$ and $R_3$ from the centerline, respectively. The dimensions $R_1$ to $R_4$ progressively increase so that $R_4$ is greater than $R_3$, $R_3$ is greater than $R_2$, and $R_2$ is greater than $R_1$—that is, $R_{i+1}>R_i$ where i is the number of the contact ring. Thus, the contact surfaces 87 of the rings 16–19 are also distributed along a cone about the centerline 88.

Moreover, the dimension by which each contact surface 87 of the contact rings 16–19 of the female sleeve 14 is displaced from the centerline 88 is equal to or, more preferably, slightly less than the dimension by which the contact surface 89 of its corresponding contact ring 60–63 of the male sleeve 38 is displaced, so that $R_i \leqq r_i$ and, more preferably, $R_i<r_i$. Thus, $R_1$ is slightly less than $r_1$, $R_2$ is slightly less than $r_2$, $R_3$ is slightly less than $r_3$, and $R_4$ is slightly less than $r_4$. Consequently, when each female contact ring 16–19 becomes axially aligned with its mating male contact ring 60–63, the male contact ring is compressed radially inward by the female contact ring against the resistance of the elastomer 193, which compresses slightly as a result of the interference. Moreover, the coefficient of thermal expansion of the elastomer 193 is preferably greater than that of the materials from which the female sleeve 14 and female contact rings 16–19 are formed so that heatup in operation will increase the interference. Thus, in service, the elastomer 193 ensures that each male contact ring 60–63 remains firmly seated against its mating female contact ring 16–19, thereby ensuring reliable communication of electrical signals.

According to the current invention, the radial displacement $R_1$ of each female contact ring 16–19 is greater than the radial displacement r of each of the male contact rings disposed in front of the male contact ring intended to contact that female contact ring so that $R_i>r_{i-1}$. Thus, $R_2$ is greater than $r_1$, $R_3$ is greater than $r_1$ and $r_2$, and $R_4$ is greater than $r_1$, $r_2$ and $r_3$. This prevents each male contact ring 60–63 from making electrical contact with any female contact ring 16–19 other than the intended mating female contact ring as the drill pipe sections are threaded or otherwise joined together so that the male end 12 travels axially into the female end 14. Premature, spurious contact is to be avoided since it can result in shorting of the electrical circuit.

Thus, upon completion of the threading of the male end 12 into the female end 14, male contact ring 60 is axially aligned with and contacts female contact ring 16, as shown in FIG. 7, thereby electrically connecting conductors 26 and 90, without ever having contacted female contact rings 17–19, under which it slid during assembly of the joint. Male contact ring 61 is axially aligned with and contacts female contact ring 17, thereby electrically connecting conductors 27 and 91, without ever having contacted female contact rings 18 or 19, under which it slid during assembly of the joint. Male contact ring 62 is axially aligned with and contacts female contact ring 18, thereby electrically connecting conductors 24 and 92, without ever having contacted female contact ring 19, under which it slid during assembly of the joint. Lastly, male contact ring 63 is axially aligned with and contacts female contact ring 19, thereby electrically connecting conductors 25 and 93.

Although the invention has been illustrated by using the resilient elastomer 193 to bias the male contact rings radially outward, the invention could also be practiced by biasing the female contact rings radially inward, for example, by embedding them in elastomer, or by biasing the contact members on both the male and female sleeves.

Figure 12A:
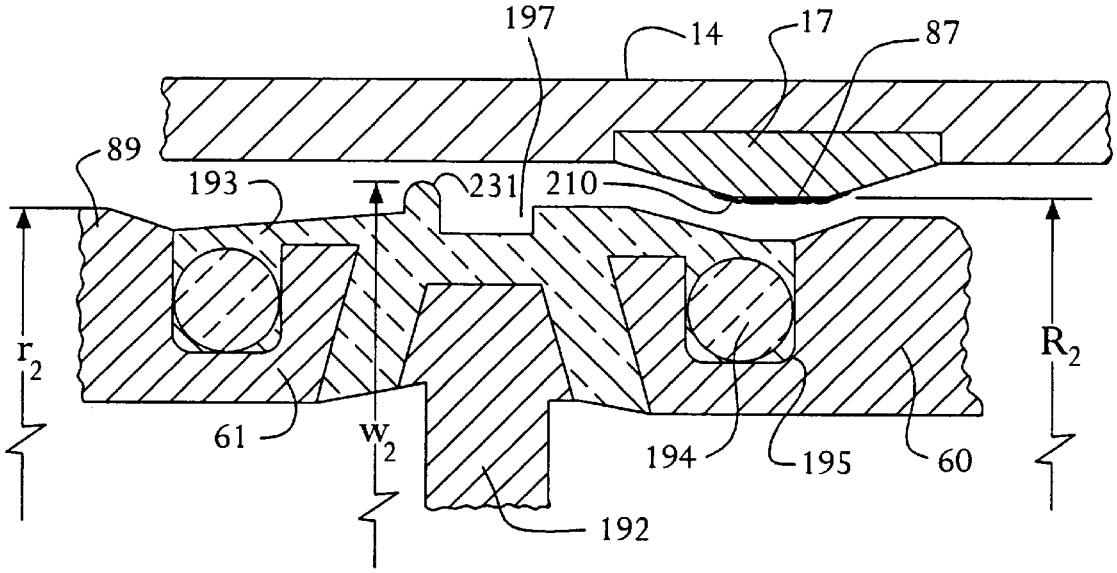
FIGS. 12(*a*), (*b*), and (*c*) show a series of views showing the insertion of the male end into the female end.
Figure 12B:
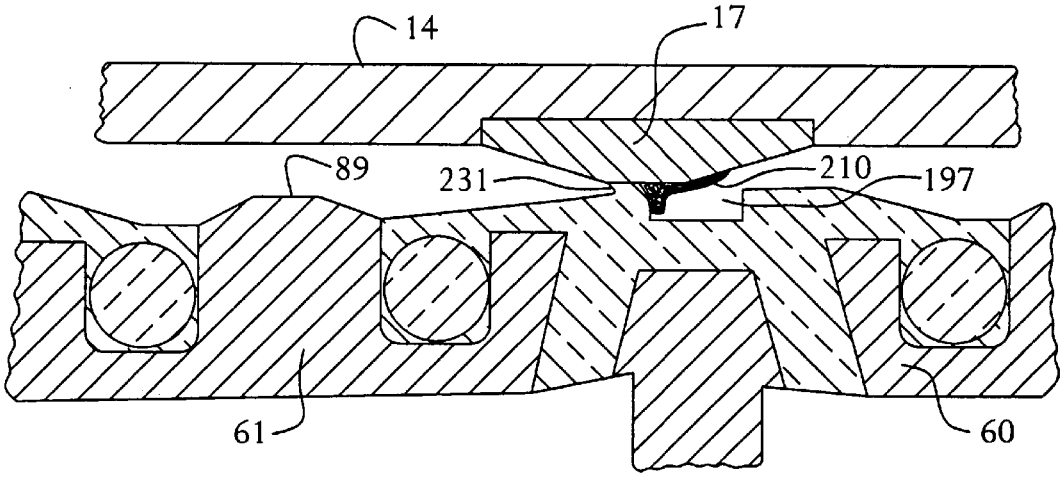
Figure 12C:
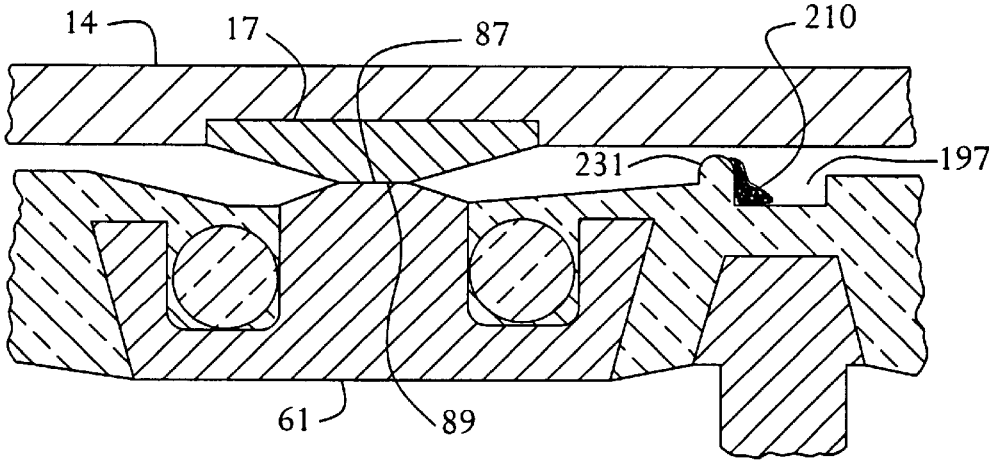

As shown in FIGS. 5, 8, and 12, according to another important aspect of the current invention, four axially spaced, circumferentially extending annular wipers 230–233 are formed by the elastomer 193 of the male sleeve 38. The wipers 230–233 are interleaved with the male contact rings 60–63 so that one wiper is located in front of each of the male contact rings. Thus, the first wiper 230 is disposed in front of the first contact 60, the second wiper 231 is disposed between the first and second contact rings 60 and 61, the third wiper 232 is disposed between the second and third contact rings 61 and 62, and the fourth wiper 233 is disposed between the third and fourth contact rings 62 and 63. In addition, circumferentially extending grooves 197 are formed in the elastomer immediately upstream of each of the wipers 230–233. As shown in FIG. 12, the distances by which the wipers 230–233 are radially displaced from the centerline 88 is $w_i$, where i is the number of the wiper. As explained in detail below, when the male end 12 axially rotates into the female end 14 during assembly of the joint, the wipers 230–233 wipe the female contact rings 16–19 clean of dirt, debris and other unwanted deposits, thereby ensuring good electrical contact between the male and female contact rings. Preferably, the distances by which the wipers 230–233 are axially spaced apart is the same as the distances by which the female contact rings 16–19 are spaced apart.

FIGS. 12(*a*)–(*c*) show a portion of the joint in the vicinity of the second female contact ring 17 as the male threads 36 are successively screwed into the female threads 34. As shown in FIG. 12(*a*), the wiper 231 disposed upstream of male contact ring 61 has not yet engaged female contact ring 17, on which foreign debris 210 is deposited, as might often occurring during assembly of the drill string in a drilling installation. As the ends are threaded together, the relative axial displacement eventually causes the wiper 231 to engage the female contact ring 17, as shown in FIG. 12(*b*). Since the outside diameter of the wiper 231 is greater than the inside diameter of the female contact ring 17, as discussed below, the wiper 231 is dragged across the contact surface 87, causing the wiper to elastically deform. As a result, the debris 210 is wiped from the contact surface 87 and deposited into the recess 197, as shown in FIG. 12(*c*), where it can do no harm. Thus, good electrical contact between the male and female contact rings is assured.

Preferably, the distances $w_i$ by which each of the wipers 230–233 are radially displaced from the centerline 88 are not only greater than the female contact ring that mates with the male contact ring located immediately behind such wiper, so that $w_i>R_i$, but each of the distances w is also greater than any of the distances $R_1$ to $R_4$ by which the female contact rings 16–19 are displaced from the centerline. Thus, during the assembly process, female contact ring 19 will be wiped clean by wipers 230–233. Female contact ring 18 will be wiped clean by wipers 230–232. Female contact ring 17 will be wiped clean by wipers 230 and 231. Lastly, female contact ring 16 will be wiped clean by wiper 230. Preferably, the nose 242 portion of the elastomeric element 193 is also radially displaced from the centerline 88 by a distance that is greater than $R_1$ to $R_4$ so that, during assembly, it serves as an initial wiper.

Thus, not only debris deposited on a contact rings prior to assembly, but debris deposited on the rings during assembly, for example, as a result of debris carried into the joint by the male end, will be wiped clean. Moreover, the recesses 197 serve to prevent the deposits removed from one female contact ring from being deposited onto the next female contact ring. For example, debris wiped from female contact ring 19 by wiper 230 will be held in the recess 197 located in front of the wiper and will not, therefore, be re-deposited onto female contact rings 16, 17 or 18 when wiper 230 passes under those rings.

The current invention could also be practiced by progressively increasing the distances by which the wipers 230–233 are displaced from the centerline 88 so that $w_{i+1}>w_i$, with $w_i>R_i$ as before but $w_i<R_{i+1}$. Thus, each female contact ring is wiped clean by only one wiper, with contact ring 16 being cleaned by wiper 230, contact ring 17 being cleaned by wiper 231, contact ring 18 being cleaned by wiper 232, and contact ring 19 being cleaned by wiper 233. In any event, in the preferred embodiment of the current invention, each female contact ring 16–19 is wiped clean at least once by a wiper as a result of the axial travel and rotation of the two adjacent drill pipe sections during coupling.

Thus, according to the invention, reliable electrical contacts among multiple conducts can be made across a drill pipe section joint without danger of premature contact or insufficient contact between the electrical connections.

While the current invention has been illustrated by reference to cleaning wipers 230–233 formed on the outside surface 33 of the male end 38 that wipe dirt and debris from the female contact rings 16–19, the invention could also be practiced by forming cleaning wipers on the inside surface of the female end that wipe clean the male contact rings 60–63. Moreover, while a threaded joint is shown in the preferred embodiment, other methods of mechanically coupling the male and female ends could also be utilized, such as flanged or welded joints, bayonet connections, etc.

Figure 13:
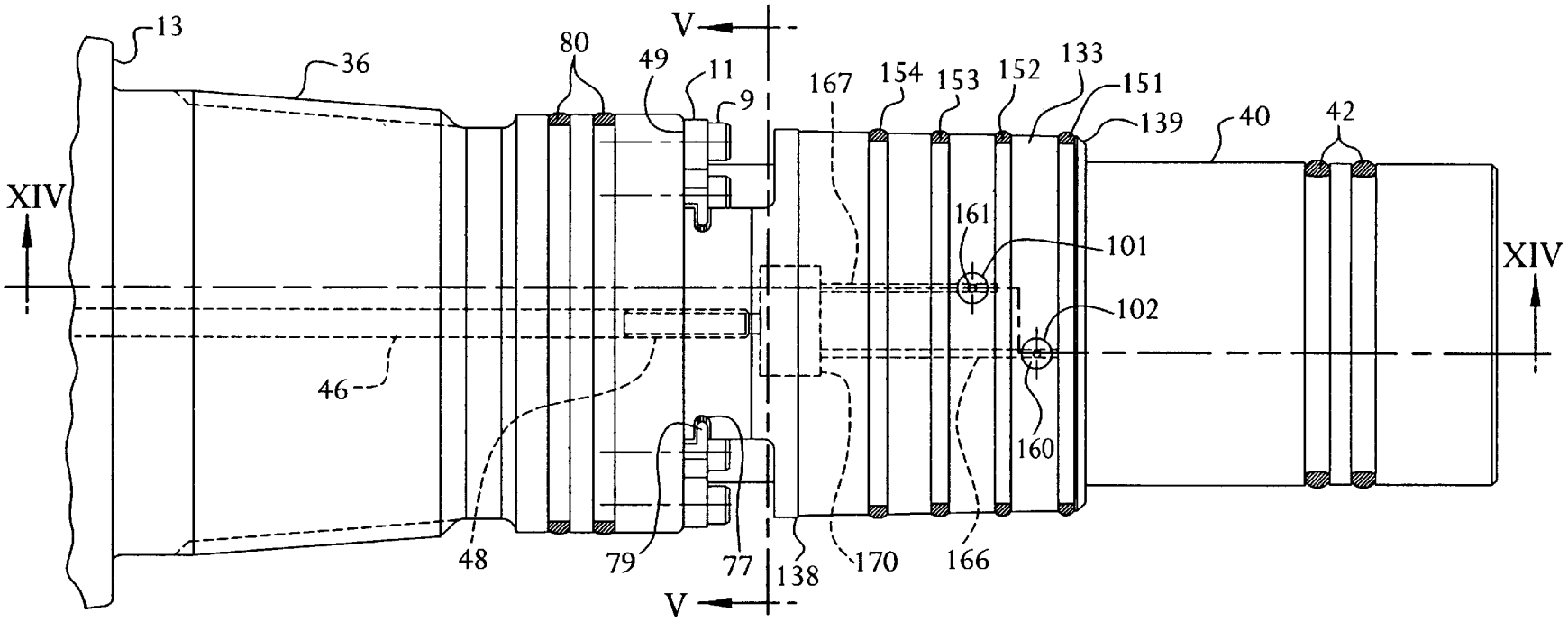
FIG. 13 is a view similar to FIG. 4 showing an alternate embody of the male end of a drill pipe section according to the current invention.

FIGS. 13–16 shown an another embodiment of the invention in which the contact members on the male sleeve 138 are formed by buttons 160–163, rather than rings. As shown in FIG. 14, four holes 101–104 are formed in the male sleeve 138. As shown in FIG. 13, two of the holes 101 and 102 are axially and circumferentially spaced apart. The other two holes, 103 and 104, are located 180° from the holes 101 and 102 and are similarly axially and circumferentially spaced, except that the holes 103 and 104 are located farther from the distal end 139 of the male sleeve 138 than the holes 101 and 102, as shown in FIG. 14.

Figure 16:
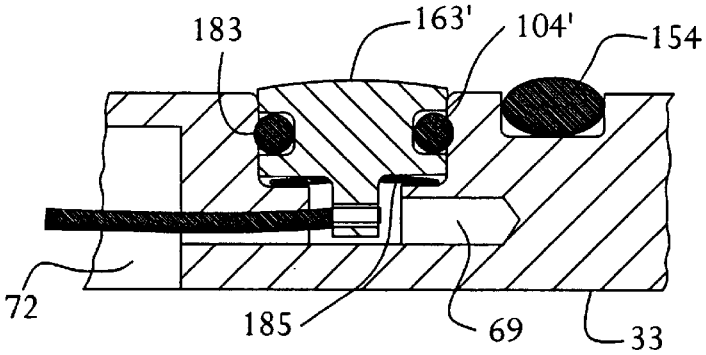
FIG. 16 is a view similar to FIG. 15 showing an alternate embodiment of the contact button.
Figure 15:
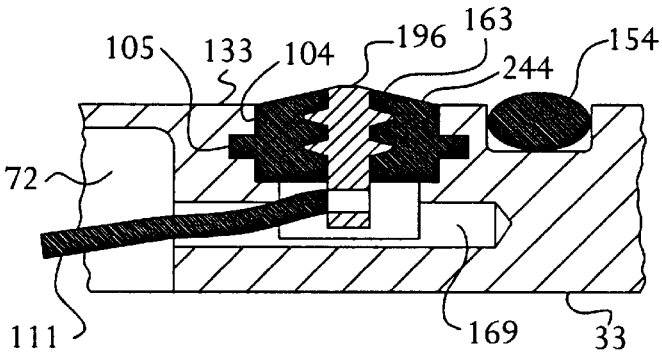
FIG. 15 is a detailed view of one of the contact buttons shown in FIG. 14.

The four axially spaced apart contact buttons 160–163 are disposed in the holes 101–104. As shown in FIG. 15, which is typical, each contact button is comprised of a barbed, electrically conductive post 196 that is retained within a surrounding resilient elastomer 244. The elastomer 244 has a flange that is retained in a groove 105 formed in the side wall of the hole 104. Importantly, the elastomeric element 244 is formed so that it elastically biases the button radially outward so that the button projects radially above the outside surface 133 of the male sleeve 138. When the buttons are pressed radially inward, the elastomer 244 imparts a resisting force that urges the button radially outward. Alternatively, metallic buttons 163' could be utilized, as shown in FIG. 16 that are sealed by an O-ring 183 and biased radially outward by an annular Belleville spring 185.

As in the case of the embodiment shown in FIGS. 2–12, the axial spacing of the contact buttons 160–163 is the same as the axial spacing of the contact rings 16–19. Further, the contact buttons 160–163 are axially displaced from the male threads 36 such that they are axially aligned with the contact rings 16–19 when the male threads are fully engaged into the female threads 34 of the adjacent drill pipe section, as shown in FIG. 14. Moreover, the radial displacements of the contact buttons 160–163 is arranged similar to that of the male contact rings 60–63, as discussed above, so that there is radial interference between the contact buttons and the female contact rings 16–19 at assembly to ensure good contact.

As shown in FIG. 14, two recesses 170 and 172 are formed 180° apart on the inner surface of the male sleeve 138. Four axially extending passages 166–169 are formed in the male sleeve 138 that connect the recesses 170 and 172 to the holes 101–104, respectively, in which the contact buttons 160–163 are located. The recesses 170 and 172 and axial passages 166–169 are used to route the conductors 90–93 to the contact buttons 160–163.

While this embodiment of the invention has been illustrated by forming contact buttons on the male end and contact rings on the female end, the invention could also be practiced by forming contact buttons on the inside surface of the female end and contact rings on the outside surface of the male end. Moreover, although this embodiment has been illustrated by biasing the contact buttons 160–163 on the male sleeve 38 radially outward, the invention could also be practiced by biasing the female contact rings 16–19 radially inward, or by biasing the contact members on both the male and female sleeves radially outward.

In the embodiment shown in FIGS. 13 and 14, cleaning elements are created by four axially spaced apart O-rings 151–154 held in circular grooves formed in the outside surface 133 of the male sleeve 138. The O-rings 151–154 are preferably deformable and most preferably formed from nitrile or viton. The distances by which the O-rings 151–154 are spaced apart is the same as the distances by which the female contact rings 16–19 are spaced apart. Further, like the wipers 230–233 discussed above, the O-rings 151–154 are interleaved with the contact buttons 160–163.

As in the case of the wipers 230–233, discussed above, the distances by which each of the O-rings 151–154 are radially displaced from the centerline 88 are preferably greater than any of the distances $R_1$ to $R_4$ by which the contact rings 16–19 are displaced from the centerline. Thus, when the male end 12 axially rotates into the female end 14, the O-rings 151–154 wipe the female contact rings 16–19 clean of dirt, debris and other unwanted deposits.

While the current invention has been illustrated with respect to a joint through which electrical connections are made in four conductors, the invention is also applicable to joints requiring a greater or lesser number of electrical connections. Moreover, although the invention has been illustrated with reference to sections of a drill string, the invention is also applicable to other multi-section tubular members carrying conductors that must be electrically connected across the joints joining the sections. Thus, the present invention may be embodied in other specific forms without departing from the spirit or essential attributes thereof and, accordingly, reference should be made to the appended claims, rather than to the foregoing specification, as indicating the scope of the invention.

What is claimed:

1. A section of drill string for use in a drill string assembly for drilling a bore through a formation, comprising:

a) a first drill pipe section comprising:

(i) a male end defining an axial centerline thereof and forming an outside surface thereof;

(ii) first and second contact members projecting radially outward from said outside surface of said male end, said first and second contact members being axially spaced apart, said first and second contact members radially displaced from said axial centerline by first and second distances, respectively, said second distance being greater than said first distance; and (iii) first and second electrical conductors, said first and second electrical conductors connected to said first and second contact members, respectively;

b) a second drill pipe section comprising:

(i) a female end forming an inside surface thereof;

(ii) third and fourth contact members projecting radially inward from said inside surface of said female end, said third and fourth contact members axially spaced apart, said third and fourth contact members radially displaced from said axial centerline by third and fourth distances, respectively, said third distance being equal to or less than said first distance, said fourth distance being:

(A) greater than said third distance, (B) greater than said first distance, and (C) equal to or less than said second distance;

(iii) third and fourth electrical conductors, said third and fourth electrical conductors connected to said third and fourth contact members, respectively;

c) means for mechanically coupling said first drill pipe section to said second drill pipe section by inserting said male end into said female end, whereby said mechanical coupling of said first and second drill pipe sections causes:

(i) said first contact member to contact with said third contact member without having contacted said fourth contact member, thereby placing said first conductor in electrical communication with said third conductor, and (ii) said second contact member to contact with said fourth contact member without having contacted said third contact member, thereby placing said second conductor in electrical communication with said fourth conductor; and d) a deformable cleaning element disposed in said first drill pipe section male end for removing dirt and debris from at least one of said third and fourth contact members on said second drill pipe section female end, said cleaning element positioned on said male end so as to clean said at least one contact member when said first drill pipe section male end is inserted into said second drill pipe section female end.

2. A section of drill string for use in a drill string assembly for drilling a bore through a formation, comprising:

a) a first drill pipe section comprising:

(i) a male end defining an axial centerline thereof and forming an outside surface thereof;

(ii) first and second contact members projecting radially outward from said outside surface of said male end, said first and second contact members being axially spaced apart, said first and second contact members radially displaced from said axial centerline be first and second distances, respectively, said second distance being greater than said first distance; and (iii) first and second electrical conductors, said first and second electrical conductors connected to said first and second contact members, respectively;

b) a second drill pipe section comprising:

(i) a female end forming an inside surface thereof;

(ii) third and fourth contact members projecting radially inward from said inside surface of said female end, said third and fourth contact members axially spaced apart, said third and fourth contact members radially displaced from said axial centerline by third and fourth distances, respectively, said third distance being equal to or less than said first distance, said fourth distance being:

(A) greater than said third distance, (B) greater than said first distance, and (C) equal to or less than said second distance;

(iii) third and fourth electrical conductors, said third and fourth electrical conductors connected to said third and fourth contact members, respectively;

c) means for mechanically coupling said first drill pipe section to said second drill pipe section by inserting said male end into said female end, whereby said mechanical coupling of said first and second drill pipe sections causes:

(i) said first contact member to contact with said third contact member without having contacted said fourth contact member, thereby placing said first conductor in electrical communication with said third conductor, and (ii) said second contact member to contact with said fourth contact member without having contacted said third contact member, thereby placing said second conductor in electrical communication with said fourth conductor; and a first wiper formed on one of said drill pipe sections for wiping foreign deposits from at least one of said contact members on the other one of said drill pipe sections during said insertion of said male end of said first drill pipe section into said female end of said second drill pipe section.

3. The drill string section according to claim 2, further comprising a recess disposed adjacent said first wiper for holding said foreign deposits wiped from said contact member by said wiper.

4. The drill string section according to claim 2, further comprising a second wiper formed on said one of said drill pipe sections for wiping foreign deposits from at least the other one of said contact members on said other one of said drill pipe sections during said insertion of said male end of said first drill pipe section into said female end of said second drill pipe section, whereby said first wiper wipes at least one of said contact members on said other one of said drill pipe sections and said second wiper wipes at least the other one of said contact members on said other one of said drill pipe sections, said first and second wipers being axially displaced.

5. The drill string section according to claim 4, further comprising first and second recess disposed adjacent said first and second wipers, respectively, for holding said foreign deposits wiped from said contact members by said wipers, whereby foreign deposits wiped by said wipers from one of said contact members will not be re-deposited onto the other of said contact members.

6. A section of drill string for use in a drill string assembly for drilling a bore through a formation, comprising:

a) a first drill pipe section comprising:

(i) a male end defining an axial centerline thereof and forming an outside surface thereof;

(ii) first and second contact members projecting radially outward from said outside surface of said male end, said first and second contact members being axially spaced apart, said first and second contact members radially displaced from said axial centerline by first and second distances, respectively, said second distance being greater than said first distance; and (iii) first and second electrical conductors, said first and second electrical conductors connected to said first and second contact members, respectively;

b) a second drill pipe section comprising:

(i) a female end forming an inside surface thereof;

(ii) third and fourth contact members projecting radially inward from said inside surface of said female end, said third and fourth contact members axially spaced apart, said third and fourth contact members radially displaced from said axial centerline by third and fourth distances, respectively, said third distance being equal to or less than said first distance, said fourth distance being:

(A) greater than said third distance, (B) greater than said first distance, and (C) equal to or less than said second distance;

(iii) third and fourth electrical conductors, said third and fourth electrical conductors connected to said third and fourth contact members, respectively;

c) means for mechanically coupling said first drill pipe section to said second drill pipe section by inserting said male end into said female end, whereby said mechanical coupling of said first and second drill pipe sections causes:

(i) said first contact member to contact with said third contact member without having contacted said fourth contact member, thereby placing said first conductor in electrical communication with said third conductor, and (ii) said second contact member to contact with said fourth contact member without having contacted said third contact member, thereby placing said second conductor in electrical communication with said fourth conductor; and d) cleaning means formed on one of said drill pipe sections for cleaning at least one of said contact members on the other one of said drill pipe sections during said insertion of said male end of said first drill pipe section into said female end of said second drill pipe section, said cleaning means comprising:

(i) means for wiping foreign deposits from said at least one contact member, and (ii) a recess for holding said foreign deposits after said wiping thereof.

7. A section of drill string for use in a drill string assembly for drilling a bore through a formation, comprising:

a) a first drill pipe section comprising:

(i) a male end defining an axial centerline thereof and forming an outside surface thereof;

(ii) first and second contact members projecting radially outward from said outside surface of said male end, said first and second contact members being axially spaced apart, said first and second contact members radially displaced from said axial centerline by first and second distances, respectively, said second distance being greater than said first distance; and (iii) first and second electrical conductors, said first and second electrical conductors connected to said first and second contact members, respectively;

b) a second drill pipe section comprising:

(i) a female end forming an inside surface thereof;

(ii) third and fourth contact members projecting radially inward from said inside surface of said female end, said third and fourth contact members axially spaced apart, said third and fourth contact members radially displaced from said axial centerline by third and fourth distances, respectively, said third distance being equal to or less than said first distance, said fourth distance being:

(A) greater than said third distance, (B) greater than said first distance, and (C) equal to or less than said second distance;

(iii) third and fourth electrical conductors, said third and fourth electrical conductors connected to said third and fourth contact members, respectively;

c) means for mechanically coupling said first drill pipe section to said second drill pipe section by inserting said male end into said female end, whereby said mechanical coupling of said first and second drill pipe sections causes:

(i) said first contact member to contact with said third contact member without having contacted said fourth contact member, thereby placing said first conductor in electrical communication with said third conductor, and (ii) said second contact member to contact with said fourth contact member without having contacted said third contact member, thereby placing said second conductor in electrical communication with said fourth conductor, and d) cleaning means formed on one of said drill pipe sections for cleaning at least one of said contact members on the other one of said drill pipe sections during said insertion of said male end of said first drill pipe section into said female end of said second drill pipe section, said cleaning means comprising a deformable member.

8. A section of drill string for use in a drill string assembly for drilling a bore through a formation, comprising:

a) a first drill pipe section comprising:

(i) a male end defining an axial centerline thereof and forming an outside surface thereof;

(ii) first and second contact members projecting radially outward from said outside surface of said male end, said first and second contact members each comprising a button, said first and second contact members being axially spaced apart, said first and second contact members radially displaced from said axial centerline by first and second distances, respectively, said second distance being greater than said first distance; and (iii) first and second electrical conductors, said first and second electrical conductors connected to said first and second contact members, respectively;

b) a second drill pipe section comprising:

(i) a female end forming an inside surface thereof;

(ii) third and fourth contact members projecting radially inward from said inside surface of said female end, said third and fourth contact members each comprising an annular ring, said third and fourth contact members axially spaced apart, said third and fourth contact members radially displaced from said axial centerline by third and fourth distances, respectively, said third distance being equal to or less than said first distance, said fourth distance being:

(A) greater than said third distance, (B) greater than said first distance, and (C) equal to or less than said second distance;

(iii) third and fourth electrical conductors, said third and fourth electrical conductors connected to said third and fourth contact members, respectively; and c) means for mechanically coupling said first drill pipe section to said second drill pipe section by inserting said male end into said female end, whereby said mechanical coupling of said first and second drill pipe sections causes:

(i) said first contact member to contact with said third contact member without having contacted said fourth contact member, thereby placing said first conductor in electrical communication with said third conductor, and (ii) said second contact member to contact with said fourth contact member without having contacted said third contact member, thereby placing said second conductor in electrical communication with said fourth conductor.

9. A section of drill string for use in a drill string assembly for drilling a bore through a formation, comprising:

a first drill pipe section comprising:

(i) a male end defining an axial centerline thereof and forming an outside surface thereof;

(ii) first and second contact members projecting radially outward from said outside surface of said male end, said first and second contact members being axially spaced apart, said first and second contact members radially displaced from said axial centerline by first and second distances, respectively, said second distance being greater than said first distance; and (iii) first and second electrical conductors, said first and second electrical conductors connected to said first and second contact members, respectively;

b) a second drill pipe section, said first and second drill pipe sections forming a central fluid passage, said second drill pipe section comprising:

(i) a female end forming an inside surface thereof;

(ii) third and fourth contact members projecting radially inward from said inside surface of said female end, said third and fourth contact members axially spaced apart, said third and fourth contact members radially displaced from said axial centerline by third and fourth distances, respectively, said third distance being equal to or less than said first distance, said fourth distance being:

(A) greater than said third distance, (B) greater than said first distance, and (C) equal to or less than said second distance;

(iii) third and fourth electrical conductors, said third and fourth electrical conductors connected to said third and fourth contact members, respectively;

c) means for mechanically coupling said first drill pipe section to said second drill pipe section by inserting said male end into said female end, whereby said mechanical coupling of said first and second drill pipe sections causes:

(i) said first contact member to contact with said third contact member without having contacted said fourth contact member, thereby placing said first conductor in electrical communication with said third conductor, and (ii) said second contact member to contact with said fourth contact member without having contacted said third contact member, thereby placing said second conductor in electrical communication with said fourth conductor; and d) means for sealing said male end outside surface and said female end inside surface from said fluid, said seal means comprises a sleeve disposed within said first and second pipe sections, said sleeve having first and second seals formed therein, said first seal in sealing contact with said first pipe section, said second seal in sealing contact with said second pipe section.

10. A section of drill string for use in a drill string assembly for drilling a bore through a formation, comprising:

a) a first drill pipe section comprising:

(i) a male end defining an axial centerline thereof;

(ii) a plurality of first contact members formed in said male end, each of said first contact members being axially spaced apart, each of said first contact members radially displaced from said axial centerline by a distance $r_i$, where i is a number representing each of said first contact members, said distance progressively increasing among said first contact members so that $r_{i+1}>r_i$; and (iii) a first electrical conductor for each of said first contact members, each of said first electrical conductors connected to its respective first contact member;

b) a second drill pipe section comprising:

(i) a female end;

(ii) a second contact member for each of said first contact members formed in said female end, each of said second contact members being axially spaced apart, each of said second contact members radially displaced from said axial centerline by a distance $R_i$, said distance $R_i$, being defined so that:

(A) $R_{i+1}>R_i$, whereby $R_i$ progressively increases from each second contact member to the next, (B) $R_i \leqq r_i$, whereby said distance $R_i$ by which each of said second contact members is displaced from said axial centerline is equal to or less than said distance by which its respective first contact member is displaced from said axial centerline; and (iii) a second electrical conductor for each of said second contact members, each of said second electrical conductors connected to its respective second contact member; and c) means for mechanically coupling said first drill pipe section to said second drill pipe section by inserting said male end into said female end, said mechanical coupling of said first and second drill pipe sections causing each of said first contact members to contact its respective second contact member, thereby placing said first conductors in electrical communication with said second conductors.

11. The drill string section according to claim 10, wherein $r_i<R_{i+1}$, whereby said mechanical coupling of said first and second drill pipe sections causes each of said first contact members to contact its respective second contact member without having contacted any of the other of said second contact members.

12. The drill string section according to claim 11, further comprising a wiper for each of said contact members on one of said drill pipe sections for wiping foreign deposits from its respective contact member during said insertion of said male end of said first drill pipe section into said female end of said second drill pipe section, said wipers formed on the other one of said drill pipe sections.

13. The drill string section according to claim 12, wherein each of said wipers is displaced from said centerline by a distance that is greater than any of said distances $R_i$, whereby each of said wipers wipes each of said contact members on said one of said drill pipe sections.

14. The drill string section according to claim 12, further comprising a recess disposed adjacent each of said wipers for holding said foreign deposits wiped by said wipers from said contact members.

15. The drill string section according to claim 10, further comprising means for urging each of said contact members on at least one of said drill pipe sections radially toward its respective contact member on the other one of said drill pipe sections.

16. A coupling assembly, comprising:

a) a first tubular member comprising:

(i) a male end defining an axial centerline thereof;

(ii) first and second contact members projecting radially outward from said male end, said first and second contact member displaced from said axial centerline by first and second distances, respectively, said second distance being greater than said first distance; and (iii) first and second electrical conductors disposed in said first tubular member, said first and second electrical conductors connected to said first and second contact members, respectively;

b) a second tubular member comprising:

(ii) a female end;

(ii) third and fourth contact members projecting radially inward from said female end, said third and fourth contact members displaced from said second axial centerline by third and fourth distances, respectively, said third distance being less than or equal to said first distance, said fourth distance being:

(A) greater than said third distance, and (B) less than or equal to said second distance;

(iii) third and fourth electrical conductors disposed in said second tubular member, said third and fourth electrical conductors connected to said third and fourth contact members;

c) means for joining said first tubular member to said second tubular member so as to form an assembly and so as to place said first and second contact members into contact with said third and fourth contact members, respectively, thereby placing said first and second conductors in electrical communication with said third and fourth conductors, respectively; and d) a wiper formed on one of said tubular members for wiping foreign deposits from at least one of said contact members on said other of said tubular members while said tubular members are being joined.

17. The coupling assembly according to claim 16, further comprising a recess formed on said one of said tubular members for holding said foreign deposits wiped by said wiper.

* * * * *

UNITED STATES PATENT AND TRADEMARK OFFICE

CERTIFICATE OF CORRECTION

PATENT NO. : 6,123,561
DATED : September 26, 2000
INVENTOR(S) : Turner et al.

It is certified that error appears in the above-identified patent and that said Letters Patent is hereby corrected as shown below:

Title page, column 1,
"Inventors", after "Ronald Seppa, Hellertown, all of Pa." insert -- and Alan J. Sallwasser, Houston, TX -- therefor.

Column 8,
Line 45, delete "distances w" and insert -- distances $w_1$ -- therefor.

Column 11, claim 2,
Line 11, delete "be first" and insert -- by first -- therefor.

Signed and Sealed this

Ninth Day of October, 2001

*Attest:*

Nicholas P. Godici

*Attesting Officer*

NICHOLAS P. GODICI
*Acting Director of the United States Patent and Trademark Office*